US007416520B1

(12) United States Patent
Danowski

(10) Patent No.: US 7,416,520 B1
(45) Date of Patent: Aug. 26, 2008

(54) CURLER EXERCISER

(75) Inventor: Thomas J. Danowski, Schaumburg, IL (US)

(73) Assignee: Brunswick Corporation, Lake Forest, IL (US)

( * ) Notice: Subject to any disclaimer, the term of this patent is extended or adjusted under 35 U.S.C. 154(b) by 648 days.

(21) Appl. No.: 10/958,748

(22) Filed: Oct. 5, 2004

(51) Int. Cl.
*A63B 21/045* (2006.01)
*A63B 23/14* (2006.01)
*A63B 21/02* (2006.01)

(52) U.S. Cl. ..... 482/127; 482/44; 482/121

(58) Field of Classification Search ..... 482/121, 482/124, 127, 140, 114–115, 44–50; 602/5, 602/16, 26
See application file for complete search history.

(56) References Cited

U.S. PATENT DOCUMENTS 4,623,141 A * 11/1986 Salvino ..... 482/49
5,358,469 A * 10/1994 Patchel et al. ..... 602/5
5,437,611 A * 8/1995 Stern ..... 602/16
5,507,712 A * 4/1996 Chang ..... 482/126
5,547,464 A * 8/1996 Luttrell et al. ..... 602/26
5,658,241 A * 8/1997 Deharde et al. ..... 602/5
6,080,090 A * 6/2000 Taylor et al. ..... 482/121
6,220,995 B1 * 4/2001 Chen ..... 482/140
6,743,159 B1 * 6/2004 Taylor et al. ..... 482/127
7,008,354 B2 * 3/2006 Wen ..... 482/127
7,077,787 B1 * 7/2006 Wiesman ..... 482/49
2002/0094919 A1 * 7/2002 Rennex et al. ..... 482/124
2005/0054498 A1 * 3/2005 Chiu ..... 482/122

* cited by examiner

*Primary Examiner*—Fenn C Mathew
(74) *Attorney, Agent, or Firm*—Andrus, Sceales, Starke & Sawall, LLP

(57) ABSTRACT

Curler exercise apparatus includes first and second frames pivotally mounted to each other at a pivot junction proximate a user's extremity joint for exercising extremity muscles against the bias of a biasing member coupled between the frames.

9 Claims, 5 Drawing Sheets

CURLER EXERCISER

BACKGROUND AND SUMMARY

The invention relates to exercise apparatus, and more particularly to curler exercise apparatus for exercising a user's extremity muscles at a pivot joint, for example an arm curler.

Various exercise apparatus are known for exercising a user's extremity muscles at a pivot joint, including for strengthening the bicep muscles of the arm. The present invention provides a simple, inexpensive and effective curler exerciser.

DETAILED DESCRIPTION

Figure 1:
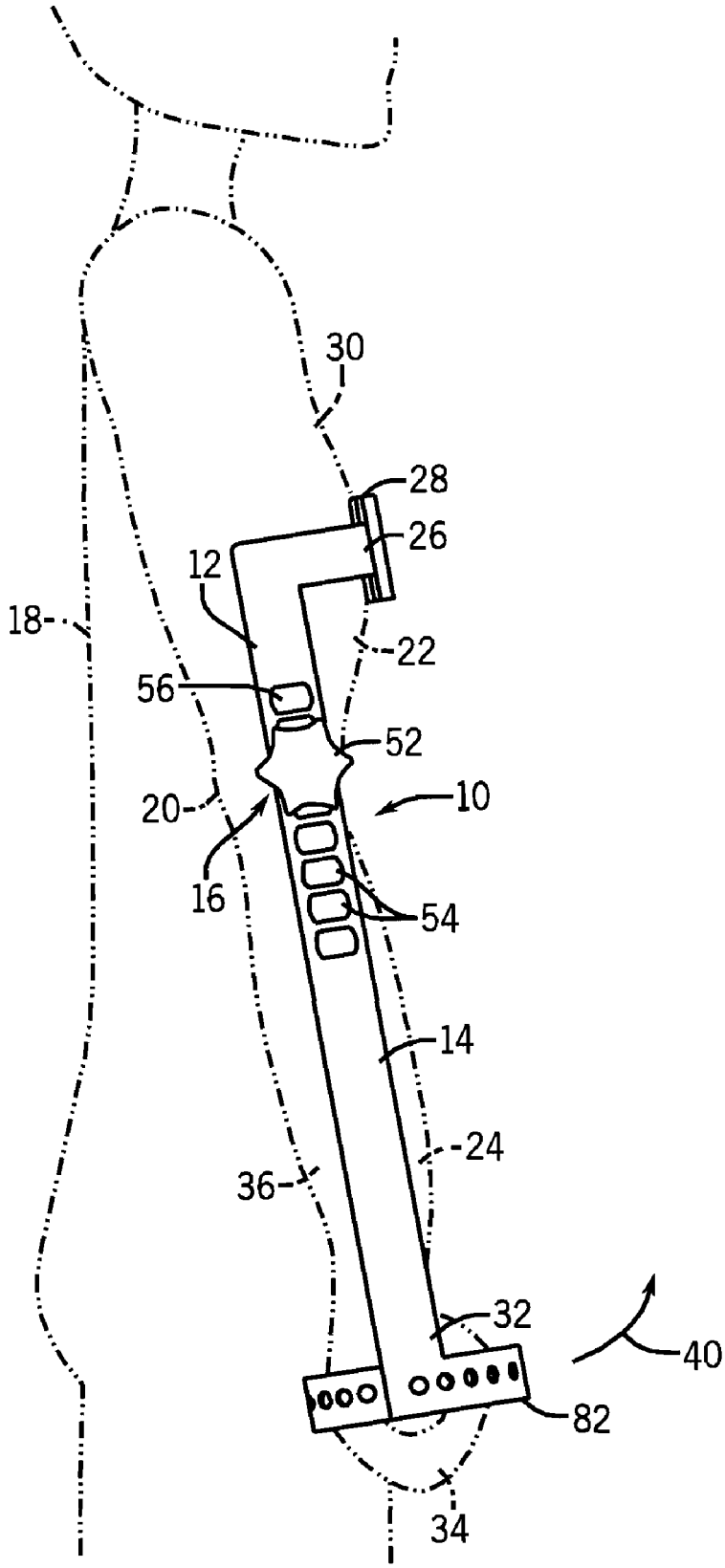
FIG. 1 is a side view of curler exercise apparatus in accordance with the invention.

FIG. 1 shows curler exercise apparatus 10 having first and second frames 12 and 14 pivotally mounted to each other at a pivot junction 16 proximate an extremity joint of a user 18, for example the user's elbow 20. Frames 12 and 14 are pivotable between first and second positions, FIGS. 1 and 2, respectively, for exercising the user's extremity muscles, for example bicep muscle 22 and forearm muscle 24. Frame 12 extends from pivot junction 16 to a first distal portion 26, which may have a pad 28, engaging the user's extremity on a first side of extremity joint 20, for example engaging the user's upperarm 30 at bicep muscle 22. Second frame 14 extends from pivot junction 16 to a second distal portion 32 engaging the extremity on a second opposite side of extremity joint 20, for example engaging the user's hand 34 at the end of his/her forearm 36. A biasing member 38, FIG. 3, is coupled between frames 12 and 14 and biases the frames toward the noted first position, FIG. 1, to be further described. Upon pivoting of the frames to the noted second position, FIG. 2, the second distal portion 32 moves in an arc 40 toward the first distal portion 26, and frame 14 pivots toward frame 12 against the bias of biasing member 38.

Frames 12 and 14 are pivotally mounted to each other by a removable axle 42, FIG. 3, extending axially therebetween. Biasing member 38 extends along axle 42 and is removable from the frames upon removal of the axle to enable replacement of the biasing member with a different biasing member to change the bias biasing frames 12 and 14 toward the noted first position of FIG. 1. In one embodiment, the biasing member is provided by a torsion spring having a hollow interior 44, and the axle is provided by a bolt having an enlarged head or cap 46, a central portion 48 extending axially through hollow interior 44 of torsion spring 38, and a threaded end 50 extending axially beyond frame 12. A threaded knob 52 threadingly engages threaded end 50 on the opposite axial side of frame 12 from torsion spring 38. Enlarged head 46 engages frame 14 on the opposite axial side thereof from torsion spring 38. The bolt extends through a selective one of apertures 54 in frame 14 and a selective one of apertures 56 in frame 12, to be further described.

Frames 12 and 14 are pivotally mounted to each other along pivot axis 58, FIG. 3. Torsion spring 38 lies along axis 58 and has a first end 60 connected to frame 12, and a second end 62 connected to frame 14. In one embodiment, torsion spring 38 is a machined spring, and end 60 has a keyed configuration keyed to frame 12 in nonrotational relation. For example end 60 has one or more flats 64 mating with one or more flats 66 of slot or aperture 56. End 62 of torsion spring 38 has a keyed configuration keyed to frame 14 in nonrotational relation. For example, end 62 has one or more flats 68 mating with one or more flats 70 of slot or aperture 54. The noted keyed configurations may take other shapes and forms. By means of such keyed configurations, spring 38 torsionally twists between ends 60 and 62 upon pivoting of frames 12 and 14 about pivot axis 58. The noted first and second sides of the extremity, such as upper arm 30 and forearm 36, are pivotable about a pivot axis at the noted pivot joint, e.g. elbow 20, and frames 12 and 14 are pivotally mounted to each other along pivot axis 58 parallel to the noted pivot axis of pivot joint 20.

Frame 14 has first and second distally opposite ends 72 and 74. First end 72 is at pivot junction 16 and has a plurality of pivot mounts therealong, provided by apertures or slots 54, for adjustably changing the distance between pivot junction 16 and second end 74 of frame 14, to accommodate differing length extremities of different users along the noted second side of the extremity joint, e.g. along forearm 36. Frame 12 has first and second distally opposite ends 76 and 78. First end 76 is at pivot junction 16 and has a plurality of pivot mounts therealong, provided by apertures or slots 56, for adjustably changing the distance between pivot junction 16 and second end 78 of frame 12, to accommodate differing length extremities of different users along the noted first side of the extremity joint, e.g. along upperarm 30. The noted lengths are adjustably changed by inserting axle bolt 42 through a selected one of apertures 54 and through a selected one of apertures 56.

Figure 2:
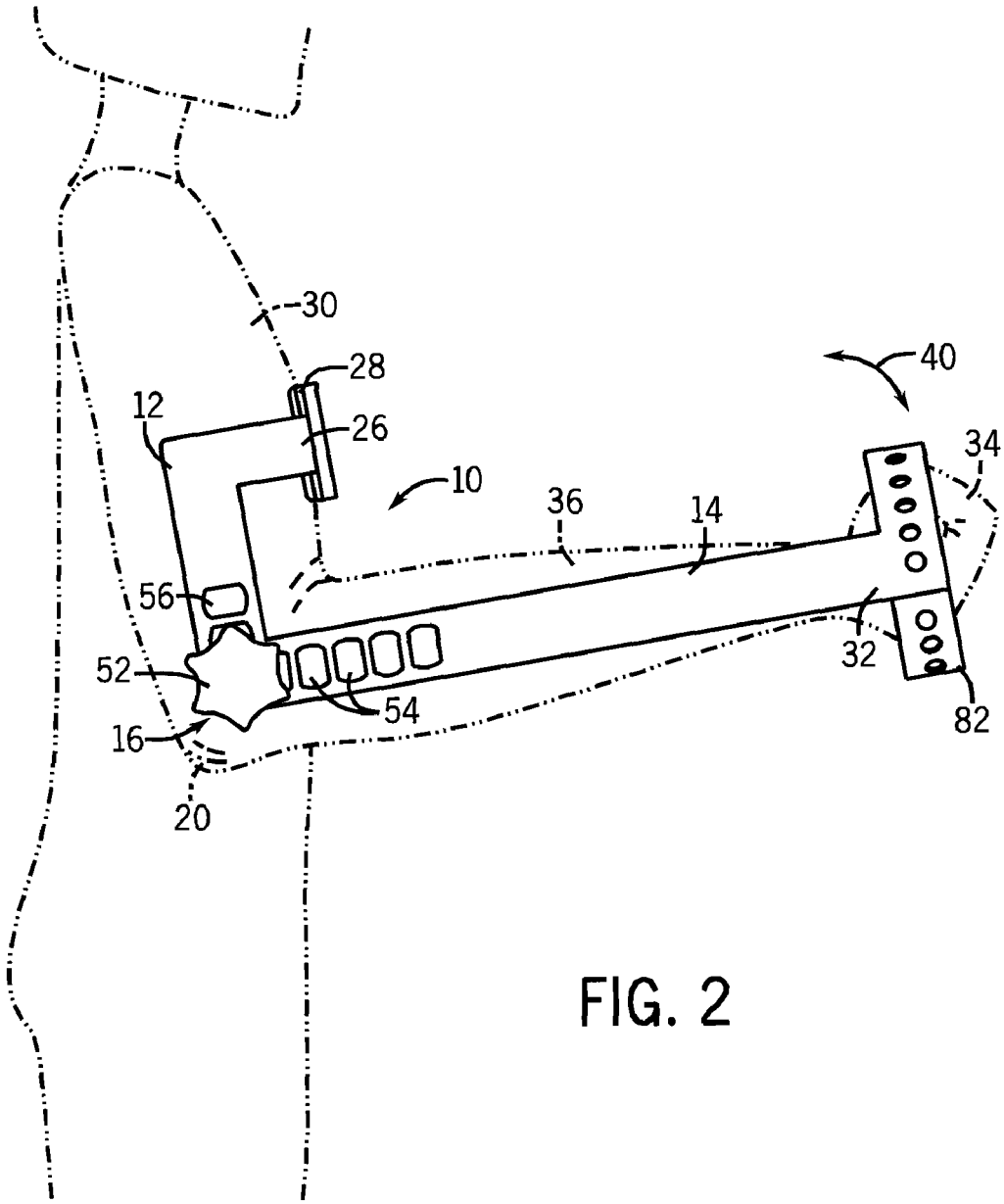
FIG. 2 is like FIG. 1 and shows a curled pivoted position.
Figure 3:
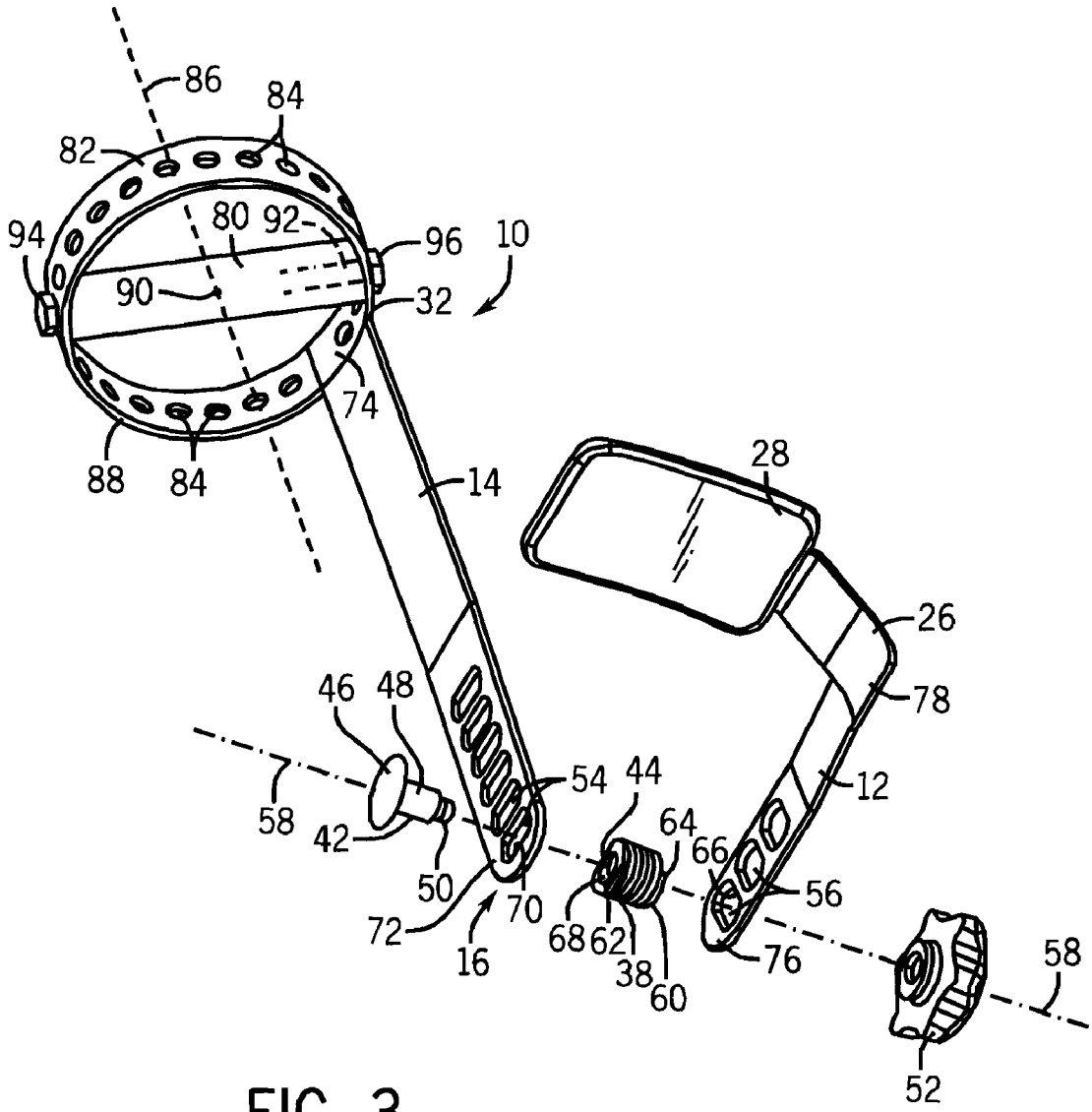
FIG. 3 is an exploded perspective view of the curler exercise apparatus of FIGS. 1 and 2.

In the embodiment of FIGS. 1-3, frame 12 is an upperarm frame, and frame 14 is a forearm frame, and the frames are pivotally mounted to each other at pivot junction 16 proximate the user's elbow 20 and are pivotable between the noted first and second positions of FIGS. 1 and 2 upon exercise of the user's bicep muscle 22. Upperarm frame 12 has the noted first and second distally opposite ends 76 and 78. First end 76 is at pivot junction 16. Upperarm frame 12 extends along the user's upperarm 30 to second end 78. Bicep pad 28 at second end 78 rests on the bicep 22 of the user. Forearm frame 14 has the noted first and second distally opposite ends 72 and 74. First end 72 of forearm frame 14 is at pivot junction 16. Forearm frame 14 extends along the user's forearm 36 to the noted second end 74. A handle grip 80 at second end 74 of forearm frame 14 is provided for gripping by the hand 34 of the user. Biasing member 38 is coupled between upperarm frame 12 and forearm frame 14 and biases the upperarm and forearm frames toward the noted first position of FIG. 1.

The noted second end 74 of forearm frame 14 includes mounting structure 82 having a plurality of handle grip mounts provided by apertures 84 adjustably mounting handle grip 80 at a plurality of orientations relative to the user's elbow 20. Upperarm and forearm frames 12 and 14 pivot about pivot axis 58 extending through pivot junction 16. The handle grip mounts 84 of mounting structure 82 adjustably vary the orientation of handle grip 80 about a handle rotation axis 86 which extends transversely to pivot axis 58. Mounting structure 82 is provided by a ring 88 defining a circle having a center 90 at handle rotation axis 86. Handle grip 80 extends across ring 88 along a diameter of the noted circle. Handle grip mounts provided by apertures 84 are arcuately spaced along ring 88 around the circumference of the circle to adjustably vary the noted orientation by re-orienting the handle grip 80 along a different diameter of the circle. Handle grip 80 may be mounted on a central bolt 92 extending therethrough and having threaded ends extending through respective apertures 84 and secured by respective nuts or threaded knobs 94 and 96 which are removable therefrom to permit the noted re-orienting of the handle grip along a different diameter of the circle.

Figure 4:
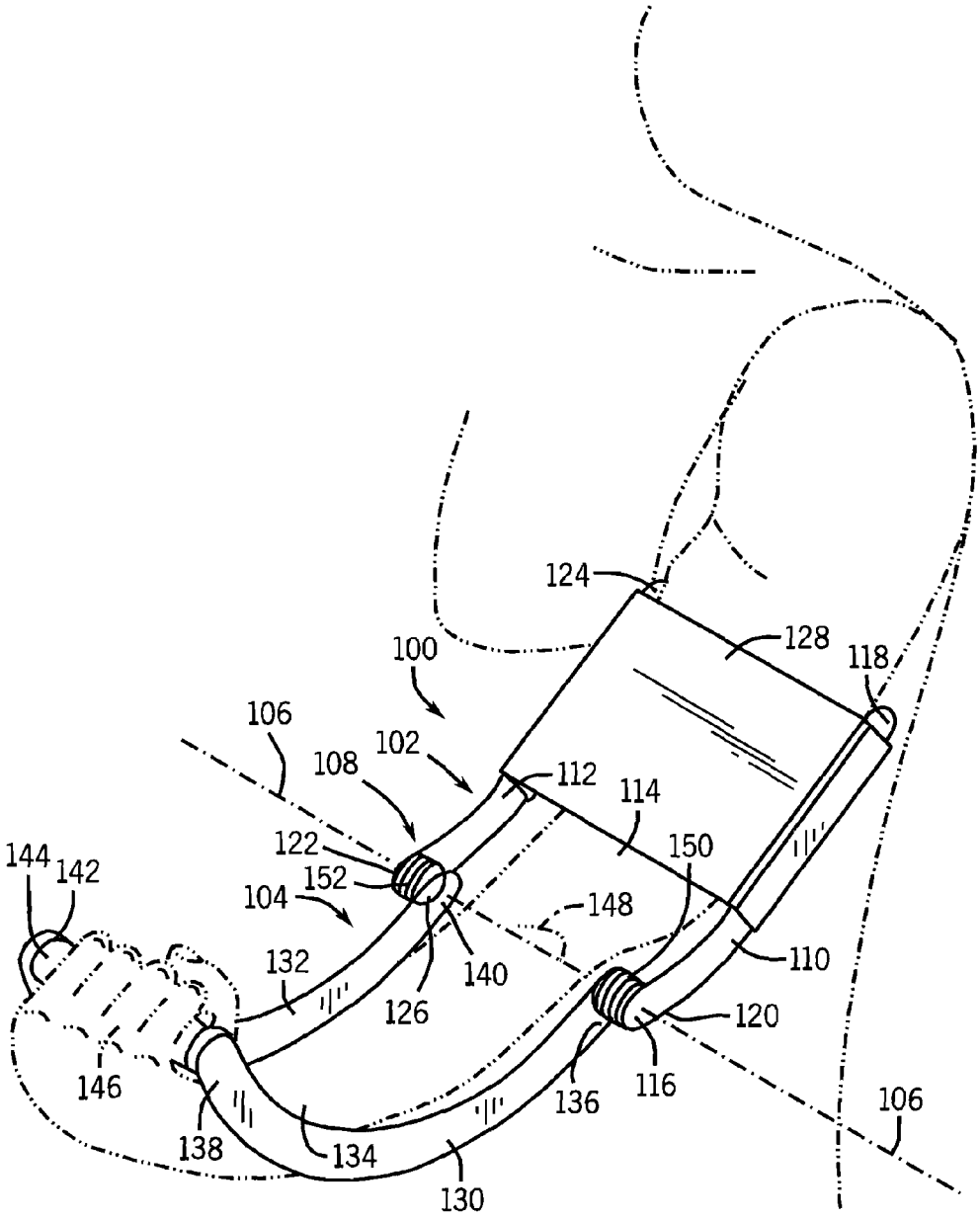
FIG. 4 is a perspective view of an alternate embodiment of curler exercise apparatus in accordance with the invention.
Figure 5:
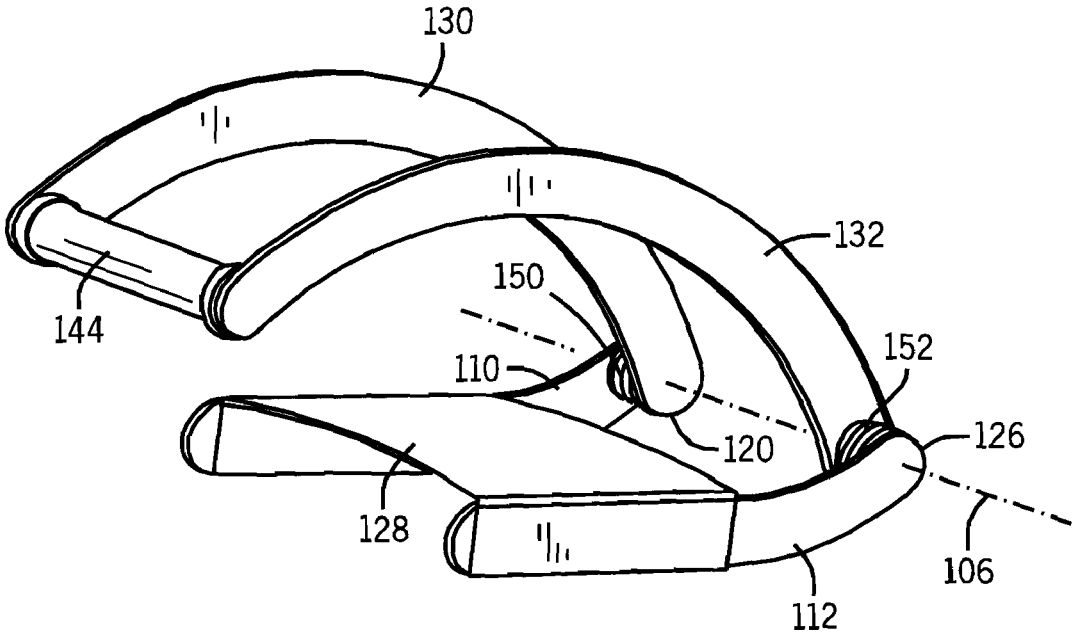
FIG. 5 is a perspective view of the curler exercise apparatus of FIG. 4 in a curled pivoted position.

FIGS. 4 and 5 show an alternate embodiment. Curler exercise apparatus 100 includes first and second frames 102 and 104, comparable to first and second frames 12 and 14 of FIGS. 1-3. Frames 102 and 104 pivot about a pivot axis 106 extending through pivot junction 108.

Frame 102 includes first and second subframe members 110 and 112 axially spaced from each other by a first portion of the user's extremity therebetween, e.g. upperarm 114. First subframe member 110 has first and second distally opposite ends 116 and 118. First end 116 is at a first pivot subjunction 120. Subframe member 110 extends along the noted first portion of the user's extremity, e.g. upperarm 114, to second end 118. Subframe member 112 has first and second distally opposite ends 122 and 124. First end 122 is at a second pivot subjunction 126. Subframe member 112 extends along the noted first portion of the user's extremity, e.g. upperarm 114, to second end 124. The noted first distal portion 26 of frame 12 in FIGS. 1-3 is provided in FIG. 4 by a pad or a web of cloth material 128 extending axially (i.e. parallel to axis 106) between second ends 118 and 124 of first and second subframe members 110 and 112, respectively.

Second frame 104 includes first and second subframe members 130 and 132 axially spaced from each other on opposite sides of a second portion of the user's extremity therebetween, e.g. forearm 134. Subframe member 130 has first and second distally opposite ends 136 and 138. First end 136 is at first pivot subjunction 120. Subframe member 130 extends along the noted second portion of the user's extremity, e.g. along forearm 134, to second end 138. Subframe member 132 has first and second distally opposite ends 140 and 142. First end 140 is at second pivot subjunction 126. Subframe member 132 extends along the noted second portion of user's extremity, e.g. along forearm 134, to second end 142. The noted second distal portion 32 of FIGS. 1-3 is provided in FIG. 4 by a handle grip bar 144 extending axially between second ends 138 and 142 of first and second subframe members 130 and 132 of second frame 104. In the embodiment of FIG. 4, handle grip bar 144 is gripped by the hand 146 of the user.

Pivot junction 16 in FIGS. 1-3 is provided in FIGS. 4 and 5 by pivot junction 108 having the noted first and second pivot subjunctions 120 and 126 axially spaced on opposite sides of the extremity of the user along pivot axis 106, e.g. axially spaced on opposites sides of the user's elbow 148. Biasing member 38 of FIGS. 1-3 is provided in FIGS. 4 and 5 by at least one spring coupled between one of the subframe members of the first frame 102 and a respective one of the subframe members of the second frame 104. In preferred form, two such springs 150 and 152 are provided, each preferably being a machined torsion spring with keyed coupling as above. First spring 150 is coupled between first subframe member 110 of first frame 102 and first subframe member 130 of second frame 104. Second spring 152 is coupled between second subframe member 112 of first frame 102 and second subframe member 132 of second frame 104.

In each of the embodiments of FIGS. 1-3 and 4-5, the curler exercise apparatus has interchangeable machined torsion springs, allowing the user to change the load as desired. The apparatus may be sold with plural sets of springs ranging from low load to high load to cover a range of desired loads.

It is recognized that various equivalents, alternatives and modifications are possible within the scope of the appended claims.

What is claimed is:

1. Curler exercise apparatus comprising first and second frames pivotally mounted to each other at a pivot junction proximate a user's extremity joint and pivotable between first and second positions for exercising extremity muscles, said first frame extending from said pivot junction to a first distal portion engaging the extremity on a first side of said extremity joint, said second frame extending from said pivot junction to a second distal portion engaging the extremity on a second opposite side of said extremity joint, a biasing member coupled between said first and second frames and biasing said first and second frames toward said first position, wherein said second distal portion moves in an arc toward said first distal portion, and said second frame pivots towards said first frame against the bias of said biasing member, upon pivoting of said first and second frames to said second position, and wherein said second frame has first and second distally opposite ends, said first end being at said pivot junction, said first end having a plurality of pivot mounts therealong for adjustably changing the distance between said pivot junction and said second end of said second frame to accommodate differing length extremities of different users along said second side of said extremity joint.

2. The curler exercise apparatus according to claim 1 wherein in combination:

said first frame has first and second distally opposite ends, said first end being at said pivot junction, said first end having a plurality of pivot mounts therealong for adjustably changing the distance between said pivot junction and said second end of said first frame;

said second frame has first and second distally opposite ends, said first end of said second frame being at said pivot junction, said first end of said second frame having a plurality of pivot mounts therealong for adjustably changing the distance between said pivot junction and said second end of said second frame;

whereby to accommodate differing length extremities of different users along both of said first and second sides of said extremity joint.

3. Arm curler exercise apparatus comprising an upperarm frame and a forearm frame pivotally mounted to each other at a pivot junction proximate a user's elbow and pivotable between first and second positions upon exercise of the user's bicep muscle, said upperarm frame having first and second distally opposite ends, said first end being at said pivot junction, said upperarm frame extending along the user's upperarm to said second end, a bicep pad at said second end for resting on the bicep of the user, said forearm frame having first and second distally opposite ends, said first end of said forearm frame being at said pivot junction, said forearm frame extending along the user's forearm to said second end of said forearm frame, a handle grip at said second end of said forearm frame for gripping by the hand of the user, a biasing member coupled between said upperarm and forearm frames and biasing said upperarm and forearm frames toward said first position, wherein said second end of said forearm frame comprises mounting structure having a plurality of handle grip mounts adjustably mounting said handle grip at a plurality of angular orientations relative to the user's elbow, wherein said upperarm and forearm frames pivot about a pivot axis extending through said pivot junction, and said handle grip mounts of said mounting structure adjustably vary the orientation of said handle grip about a handle rotation axis which extends transversely to said pivot axis.

4. The arm curler exercise apparatus according to claim 3 wherein said mounting structure comprises a ring defining a circle having a center at said handle rotation axis, and wherein said handle grip extends across said ring along a diameter of said circle, said handle grip mounts being arcuately spaced along said ring around the circumference of said circle to adjustably vary said orientation by re-orienting said handle grip along a different diameter of said circle.

5. Arm curler exercise apparatus comprising an upperarm frame and a forearm frame pivotally mounted to each other at a pivot junction proximate a user's elbow and pivotable between first and second positions upon exercise of the user's bicep muscle, said upperarm frame having first and second distally opposite ends, said first end being at said pivot junction, said upperarm frame extending along the user's upperarm to said second end, a bicep pad at said second end for resting on the bicep of the user, said forearm frame having first and second distally opposite ends, said first end of said forearm frame being at said pivot junction, said forearm frame extending along the user's forearm to said second end of said forearm frame, a handle grip at said second end of said forearm frame for gripping by the hand of the user, a biasing member coupled between said upperarm and forearm frames and biasing said upperarm and forearm frames toward said first position, wherein said second end of said forearm frame moves in an arc toward said second end of said upperarm frame, and said forearm frame pivots toward said upperarm frame against the bias of said biasing member upon pivoting of said upperarm frame and forearm frame to said second position, and wherein said forearm frame has first and second distally opposite ends, said first end being at said pivot junction, said first end having a plurality of pivot mounts therealong for adjustably changing the distance between said pivot junction and said second end of said forearm frame to accommodate differing length forearms of different users.

6. The arm curler exercise apparatus according to claim 5 wherein in combination:

said upperarm frame has first and second distally opposite ends, said first end of said upperarm frame being at said pivot junction, said first end of said upperarm frame having a plurality of pivot mounts therealong for adjustably changing the distance between said pivot junction and said second end of said upperarm frame;

whereby to accommodate differing length upperarms and forearms of different users.

7. Curler exercise apparatus comprising first and second frames pivotally mounted to each other at a pivot junction proximate a user's extremity joint and pivotable between first and second positions for exercising extremity muscles, said first frame extending from said pivot junction to a first distal portion engaging the extremity on a first side of said extremity joint, said second frame extending from said pivot junction to a second distal portion engaging the extremity on a second opposite side of said extremity joint, a biasing member coupled between said first and second frames and biasing said first and second frames toward said first position, wherein said second distal portion moves in an arc toward said first distal portion, and said second frame pivots towards said first frame against the bias of said biasing member, upon pivoting of said first and second frames to said second position, wherein said first and second frames are pivotally mounted to each other along a pivot axis, and said biasing member comprises a torsion spring along said axis and having a first end connected to said first frame and a second end connected to said second frame, and wherein at least one of said first and second ends of said torsion spring has a keyed configuration mounted to a respective one of said first and second frames at a selected angular position about said pivot axis, wherein said one end of said torsion spring is key mounted to said one frame at a plurality of selectable keyed mounting positions angularly spaced relative to said pivot axis.

8. Curler exercise apparatus comprising first and second frames pivotally mounted to each other at a pivot junction proximate a user's extremity joint and pivotable between first and second positions for exercising extremity muscles, said first frame extending from said pivot junction to a first distal portion engaging the extremity on a first side of said extremity joint, said second frame extending from said pivot junction to a second distal portion engaging the extremity on a second opposite side of said extremity joint, a biasing member coupled between said first and second frames and biasing said first and second frames toward said first position, wherein said second distal portion moves in an arc toward said first distal portion, and said second frame pivots towards said first frame against the bias of said biasing member, upon pivoting of said first and second frames to said second position, wherein said first and second frames are pivotally mounted to each other along a pivot axis, and said biasing member comprises a torsion spring along said axis and having a first end connected to said first frame and a second end connected to said second frame, and wherein at least one of said first and second ends of said torsion spring has a keyed configuration mounted to a respective one of said first and second frames at a selected angular position about said pivot axis, wherein said one end of said torsion spring and said one frame engage in keyed slotted relation, one of said one end of said torsion spring and said one frame having a slot engaging the other of said one end of said torsion spring and said one frame in keyed configuration in said non-rotational relation.

9. The curler exercise apparatus according to claim 8 wherein said slot has one or more flats, and said other of said one end of said torsion spring and said one frame has one or more flats mating with said one or more flats of said slot.

* * * * *